United States Patent [19]

Wells

[11] 3,943,017

[45] Mar. 9, 1976

[54] EXPLOSIVE COMPOSITION COMPRISING HMX, RDX, OR PETN AND A HIGH VISCOSITY NITROCELLULOSE BINDER PLASTICIZED WITH TMETN

[75] Inventor: Franklin B. Wells, Memphis, Tenn.

[73] Assignee: The United States of America as represented by the Secretary of the Army, Washington, D.C.

[22] Filed: Mar. 26, 1974

[21] Appl. No.: 454,900

[52] U.S. Cl. ..... 149/19.8; 149/92; 149/93; 149/94

[51] Int. Cl.$^2$C06B 25/34; C06B 25/32; C06B 25/28

[58] Field of Search ..... 149/19.8, 92, 93, 94

[56] References Cited

UNITED STATES PATENTS

| | | | |
|---|---|---|---|
| 3,317,361 | 5/1967 | Hooper et al. | 149/19.8 |
| 3,354,010 | 11/1967 | Hooper et al. | 149/92 X |
| 3,400,025 | 9/1968 | Hooper et al. | 149/19.8 |
| 3,489,623 | 1/1970 | Griffith et al. | 149/94 X |
| 3,689,331 | 9/1972 | Pierce | 149/96 X |
| 3,723,207 | 3/1973 | Camp | 149/94 X |

*Primary Examiner*—Edward A. Miller

*Attorney, Agent, or Firm*—Nathan Edelberg; Robert P. Gibson; Ronald M. Spann

[57] ABSTRACT

This invention relates to self-supporting, water-resistant explosive compositions composed essentially entirely of explosively active ingredients and methods for making same. The compositions consist essentially of a particulate high explosive and a high viscosity nitrocellulose binder plasticized with TMETN (trimethylolethane trinitrate) without the use of other plasticizers.

5 Claims, No Drawings

EXPLOSIVE COMPOSITION COMPRISING HMX, RDX, OR PETN AND A HIGH VISCOSITY NITROCELLULOSE BINDER PLASTICIZED WITH TMETN

The invention described herein may be manufactured, used and licensed by or for the Government for governmental purposes without the payment to me of any royalty thereon.

BACKGROUND OF THE INVENTION

Liquid organic nitric esters which have been tested for possible use as plasticizers for nitrocellulose include glycerol trinitrate, glycol dinitrate diethylene glycol dinitrate, triethyleneglycol dinitrate (TEGDN), 1,2,4-butanetriol trinitrate (BTTN), and 1,2,6-hexanetriol trinitrate. While all of these, and other similar materials, may be used as energetic plasticizers for nitrocellulose under varying conditions, all suffer from various drawbacks such as high sensitivity, headache inducing properties, low power and/or brisance, poor colloiding activity, etc. Trimethylolethane trinitrate (TMETN), because of its relatively low sensitivity, its high explosive power, and its lack of headache inducing properites is a desirable plasticizer for use in the preparation of flexible explosive compositions containing essentially 100% active ingredients, but its lack of colloiding power has largely discouraged its practical use as a plasticizer for nitrocellulose in the past. Upon contact with ordinary low viscosity nitrocellulose, TMETN softens the surfaces of the nitrocellulose fibers but is incapable of achieving penetration and complete colloidation of such nitrocellulose and hence is considered unsuitable for the preparation of single and multiple base propellants. The high viscosity, high molecular weight nitrocellulose required for use in the present invention is even less affected by TMETN, although it has been found in the course of the development of this invention that long term milling may be used to accomplish such colloiding action. As noted in U.S. Pat. No. 3,400,025, the difficulty experienced in colloiding nitrocellulose with TMETN may be partially overcome by employing TMETN in combination with a substantial proportion of an inert plasticizer, such as acetyl tributyl citrate, and carrying out the colloiding procedure in the presence of a volatile colloiding agent, such as butyl or ethyl acetate or acetone, which is later driven off leaving the nitrocellulose completely colloided with the mixture of TMETN and inert nonvolatile plasticizer. Attempts to extend this process to the preparation of flexible explosive compositions containing a nitrocellulose/TMETN binder system which did not contain acetyle tributyl citrate, or similar supplementary inert plasticizer, resulted in the formation of rather hard compositions having little or no flexibility and poor flexure strength.

Further, in previous work on flexible sheet explosives disclosed in U.S. Pat. Nos. 3,317,361, 3,354,010 and 3,400,025, it has been found that low viscosity nitrocellulose could not be substituted for high viscosity nitrocellulose in the binder system when an inert (nonexplosive) ester, or a mixture of a liquid organic nitric acid ester and an inert ester was used as plasticizer. In preliminary experimental work connected with perfection of this invention, 37 batches of material were prepared wherein TMETN or TEGDN was used as the plasticizer and various propellant and lacquer grade nitrocelluloses containing 12–13% nitrogen and ranging in viscosity from about ½ to 18 seconds were used alone and in conjunction with high viscosity nitrocellulose. It was found that the low viscosity nitrocelluloses were not suitable replacements for high viscosity nitrocellulose. As increasing proportions of high viscosity nitrocellulose were substituted with low viscosity nitrocellulose, the strength of the processed flexible composition decreased until at complete substitution of high viscosity nitrocellose in the binder, the product became too weak to serve any useful role as a sheet explosive.

SUMMARY OF THE INVENTION

An object of this invention is to provide a flexible explosive composition of high power (at least 125% of the explosive power of TNT) and high brisance (rate of detonation at least 7500 m/sec.) based on a finely divided explosive such as cyclotetramethylenetetranitramine (HMX), cyclotrimethylenetrinitramine (RDX), pentaerythritol tetranitrate (PETN), or mixtures of any two or all three of these.

Another object of this invention is to provide an explosive composition which, in the form of sheets of at least one-quarter inch thickness, possesses sufficient flexibility so that it may be made to conform to the contours of uneven surfaces with a minimum of manipulation, thus aiding in the complete destruction of the device to be demolished.

A further object of the invention is to provide a flexible explosive composition having high resistance to impact and friction while retaining good cap-sensitivity characteristics.

A still further object of this invention is to provide a flexible explosive composition which is not adversely affected by water.

Other and further objects of this invention will become apparent as the invention is further described hereinafter.

In accordance with the present invention it has been found that the foregoing objects can be achieved and self-supporting, high powered, brisant explosive compositions, containing a particulate high explosive of the group consisting of RDX, HMX, and PETN, and a high viscosity nitrocellulose/TMETN binder system, can be obtained without the use of supplementary plasticizers by employing these ingredients in certain novel, critical proportions. More particularly, the novel compositions of this invention are composed essentially entirely of explosive ingredients and consist essentially of a. 46 to 87% by weight of a finely divided high explosive selected from the group consisting of RDX, HMX and PETN, and mixtures thereof;
b. 1 to 4% by weight of explosive, high-viscosity, nitrocellulose binder; and
c. 12 to 49% by weight of the explosive liquid plasticizer TMETN, the ratio of said plasticizer to said nitrocellulose being in the range 6.5/1 to 15/1.

The high explosives employed in the compositions of the present invention possess an average particle size of not over about 25 microns. Preferably, 100% of the particulate explosive must pass through a No. 200 U.S.S. sieve and at least 90%, and preferably not less than 94%, shall pass through a No. 325 U.S.S. sieve. Use of coarser grades of particulate high explosive results in increased flexibility of the product in which the grains of particulate explosive are readily visible.

A content of less than about 46% fine particulate explosive in the explosive compositions of this invention is insufficient to provide the body necessary for obtaining smooth sheets by rolling procedures; more than about 70% generally results in a product, which cannot be processed easily by rolling but is suitable for compression molding.

The high viscosity nitrocellulose binder employed in the compositions of this invention contains about 12.1–12.5% nitrogen and is of such a degree of polymerization as to have a viscosity of at least 90 seconds, using a 4% solution and a 5/16-inch diameter steel ball as described below, sufficient TMETN plasticizer to provide the desired degree of flexibility in the finished product, and, preferably, a stabilizer such as diphenylamine (DPA) in an amount of about 5% based on the nitrocellulose present.

In the determination of the nitrocellulose viscosity aforementioned, the 5/16-inch diameter steel ball shall weigh about 2.025–2.045 grams, the viscosimeter shall consist of a vertically mounted glass tube 14 inches long with an internal diameter of 1 inch immersed to the level of its liquid contents in a constant temperature bath maintained at 25° ± 0.2°C., and the time of passage of the ball between markings shall be noted as the viscosity (in seconds).

The aforementioned viscosity test is run in accordance with paragraphs 4.4.5 et seq. of Specification MIL-N-244A dated Feb. 13, 1962 with the exception that the quantities of materials used shall be: 8 grams nitrocellulose, 21.3 grams ethanol and 170.7 grams acetone. The 21.3/170.7 gram alcohol/acetone ratio is used to maintain an essentially ⅛ ratio as is required in the specification.

Compositions of this invention, which are sufficiently plastic to permit rolling into sheets of good flexibility, are obtained when the ratio of TMETN to high viscosity nitrocellulose is at least about 9/1 parts by weight. As this ratio is increased beyond about 10/1, the product becomes softer and more flexible until at a ratio of about 15/1, the presence of unabsorbed TMETN usually becomes apparent. As this ratio is decreased below about 9/1 the product generally becomes more difficult to process by rolling, and at a ratio below about 8/1 the product generally becomes crumbly, brittle and impossible to process by rolling; however, at ratios as low as 6.5/1 the product is still sufficently pliable that it can be processed by conventional compression molding techniques into strong pellets of high density.

Preferred compositions of the present invention, which possess good placticity and can be readily rolled into sheets of good flexibility, consist essentially of a. 46 to 70% by weight of a finely divided explosive selected from the group consisting of RDX, HMX and PETN, and mixtures thereof;
b. 3 to 4% by weight of explosive, high-viscosity, nitrocellulose binder; and
c. 33 to 49% by weight of the explosive liquid plasticizer TMETN, the ratio of said plasticizer to said nitrocellulose being in the range 9/1 to 15/1.

If desired for camouflage purposes, an olive-drab coloration may be imparted to the explosive composition of this invention through incorporation therein of about 0.2–1.0% of a pigment mixture of about 1 part lampblack and 8 parts lead chromate (chrome yellow, medium). Less than about 0.2% pigment imparts insufficient coloring for adequate camouflage and no improvement is gained in coloring effectiveness by increasing the amount of pigment used to more than 1% as is noted in U.S. Pat. Nos. 3,317,361, 3,354,010 and 3,400,025.

The following examples illustrate but do not limit the invention.

EXAMPLE I

Three mixtures were prepared to determine the effect of small variations of the plasticizer TMETN upon physical characteristics of the products obtained as about ¼-inch thick sheet through use of a roll mill.

| Composition No. | 1 | 2 | 3 |
|---|---|---|---|
| RDX, Type B, Class E[1] | 46.0% | 49.0% | 52.0% |
| Nitrocellulose (96-second)[2] | 4.0 | 4.0 | 4.0 |
| Pigment | 0.8 | 0.8 | 0.8 |
| TMETN | 49.2 | 46.2 | 43.2 |

[1]All RDX used in the preparation of the compositions of this invention is Type B and of the class specified and is in accordance with the requirements of specification MIL-R-398C dated Aug. 22, 1962 and is in an essentially anhydrous state unless otherwise noted. The RDX used will be further referred to by class only.
[2]All nitrocellulose used in the preparation of the compositions of this invention is 96-second material as determined by the viscosity test noted hereinabove and is in an essentially anhydrous condition unless otherwise noted. The nitrocellulose used will be further referred to simply as nitrocellulose.

The dry ingredients were first mixed together by hand in the presence of sufficient ethanol (about 15 ml./100g. of dry ingredients) to form a tnick paste. Ethyl acetate (about 20 ml./100g. total composition) was then stirred in. This produced a very lumpy paste. After 16 hours aging, the material had become a relatively uniform soft gel. The TMETN was stirred in and the mixture again aged at least 16 hours after which it was mixed about 15 minutes in a closed sigma blade mixer held at 135°–145° and then again aged at least 16 hours. The aged mixture was then processed on a small laboratory roll mill held at not less than 135°F., in most cases. Rolling was first carried out with a roll gap of 0.020 inch for at least 2 minutes after all odor of solvents had disappeared from the material on the rolls. The material was then removed from the rolls as a thin sheet, the gap setting increased to 0.230–0.240 inch and the thin sheet material consolidated into a sheet about ¼ inch in thickness at a roll temperature 0°–15°F. lower than that used to drive off solvent and assure uniformity of composition. In subsequent preparational work it was found that most of the aging steps used in this exmaple may be omitted. The roll milling process described produced smooth, flexible, rubbery, olive-drab sheets from all three compositions, the sheet obtained from Composition 3 being slightly stiffer than the others. No difference in strength was detected in comparison of the sheets obtained from Compositions 1 and 2.

EXAMPLE II

Five compositions were prepared in order to examine the effect of varying the solids loading with appropriate reduction of the content of plasticized binder.

| Composition No. | 4 | 5 | 6 | 7 | 8 |
|---|---|---|---|---|---|
| RDX, Class E | 60.2% | 63.0% | 73.2% | 80.5% | 87.0% |
| Nitrocellulose | 3.0 | 3.0 | 2.0 | 1.5 | 1.0 |
| Pigment | 0.8 | 0.8 | 0.8 | — | — |
| TMETN | 36.0 | 33.2 | 24.0 | 18.0 | 12.0 |

In all cases the dry ingredients were well mixed by hand, 20–25 ml. ethyl acetate/100 g. dry ingredients and then the TMETN stirred in by hand and the mix covered and aged at least 16 hours. It was then again hand mixed and transferred to the roll mill where the rolling process described in Example I was carried out. Compositions 4, 5 and 6 were rolled at 160°F. or more as difficulty was encountered in producing a ¼-inch thick sheet at lower temperatures. Compositions 4 and 5 yielded rather tough sheets with that from Composition 5 being somewhat rough surfaced. The sheet of Composition 6 material was weak when hot but it cooled to a rather hard and tough consistency which was somewhat brittle in comparison with the sheets of Compositions 4 and 5 materials. Compositions 7 and 8 could not be rolled into sheets, but these compositions are suitable for compression molding purposes when properly prepared in granular form.

EXAMPLE III

Composition 9

The ability to prepare the compositions of this invention in the absence of volatile colloiding agents for nitrocellulose is illustrated by the preparation of Composition 9 containing 50% RDX, Class E, 4nitrocellulose, and 46% TMETN. The RDX and nitrocellulose were mixed with ethanol to form a stiff smooth paste. The TMETN was then stirred in and the resultant mixture was a stiff lump. After standing for a few hours, this material was roll milled 20 minutes at 165°F. using a 0.020 inch roll gap. It was then consolidated into an essentially ¼-inch thick sheet at 165°F. using a roll gap of 0.230 inch. The white sheet thus prepared was smooth and uniform in appearance, flexible and rubbery.

Examples IV and V, compositions 10–17, show that flexible plastic products can be obtained by employing TMETN together with various amounts of such undesirably sensitive explosive plasticizers as BTTN and DEGDN. They also illustrate the increasing body of the product obtained as the proportion of TMETN in the plasticizer approaches 100% of the total plasticizer. The use of other explosive plasticizers, such as BTTN and DEGDN, is not contemplated in the present invention in view of their undesirable properties of excessive sensitivity, etc., as noted above, which would be introduced by employing them in significant amounts together with TMETN in subject compositions.

EXAMPLE IV

The compositions of this example illustrate the use of the sensitive plasticizer BTTN in the preparation of flexible sheet explosive compositions.

| Composition No. | 10 | 11 | 12 | 13 |
|---|---|---|---|---|
| RDX, Class E | 50.0% | 50.0% | 50.0% | 50.0% |
| Nitrocellulose | 8.0 | 8.0 | 6.0 | 4.0 |
| Pigment | 0.8 | — | 0.80 | — |
| DPA | 0.4 | 0.4 | 0.30 | 0.2 |
| BTTN | 40.8 | 37.6 | 21.46 | 4.0 |
| TMETN | — | 4.0 | 21.44 | 41.8 |

These compositions were made into essentially ¼-inch thick sheets by the process described in EXample II using a temperature of 135°–140° for rolling into thin sheets. To form essentially ¼-inch sheets Compositions 10 and 11 were rolled at 104°–106°F., Composition 12 at 109°F., and Composition 13 at 131°F. In all cases smooth flexible sheets were obtained which exhibited increasing body with increasing TMETN and corresponding decreasing BTTN content.

EXAMPLE V

The compositions of this example illustrate the use of the sensitive plasticizer DEGDN in the preparation of flexible sheet explosive compositions.

| Composition No. | 14 | 15 | 16 | 17 |
|---|---|---|---|---|
| RDX, Class E | 50.0% | 50.0% | 50.0% | 50.0% |
| Nitrocellulose | 8.0 | 8.0 | 6.0 | 4.0 |
| Pigment | 0.8 | — | 0.80 | — |
| DPA | 0.4 | 0.4 | 0.30 | 0.2 |
| DEGDN | 40.8 | 37.6 | 21.44 | 2.0 |
| TMETN | — | 4.0 | 21.46 | 43.8 |

These compositions were formed into substantially ¼-inch thick sheets by the process described in Example II. All were rolled at a gap setting of 0.020 inch at 135–140°C. To form essentially ¼-inch thick sheets, Composition 14 was rolled at 113°F., Composition 15 at 110°F., Composition 16 at 120°F., and Composition 17 at 158°F. Smooth flexible sheets were obtained which exhibited increasing body with increasing TMETN and accompanying decreasing DEGDN content. The sheets obtained by using Compositions 14, 15 and 16 were somewhat softer than that of Composition 2 in Example I. The sheet of Composition 17, except for the color difference, appeared to have physical characteristics identical with those of the sheet of Composition 2, Example I.

EXAMPLE VI

Composition 18

This example illustrates the use of PETN as the particulate high explosive in the flexible compositions of this invention. The PETN used here was very fine grained as illustrated by a crude qualitative procedure where it was found that the subject PETN passed through a No. 325 U.S. Standard sieve more readily than did a similar weight of Class E RDX which had previously been passed through the same No. 325 screen to remove particles greater than 44 microns in size. By the process described in Example II Composition 18, a mixture of 50% PETN, 4% nitrocellulose and 46% TMETN, was processed to form an essentially ¼-inch thick sheet. Rolling was done at 155°–165°F. At 150°F. and below the sheet tended to break apart during rolling. The said sheet was noticeably stiffer than that obtained by rolling Composition 2 of Example I.

EXAMPLE VII

This example illustrates the use of acetone as a volatile nitrocellulose colloiding agent and the effect upon the product of the use of coarse-grained particulate high explosive in the compositions of this invention.

| Composition No. | 19 | 20 | 21 |
|---|---|---|---|
| RDX, Class E | 49.0% | — | — |
| HMX, Type II, Class B[1] | — | — | 12.0% |
| HMX, Type II, Class D[1] | — | 49.0% | 38.0 |
| Nitrocellulose | 4.0 | 4.0 | 4.0 |
| Pigment | 0.8 | 0.8 | — |
| TMETN | 46.2 | 46.2 | 46.2 |

[1]All HMX used in the preparation of compositions of this invention is Type II and of the class specified and is in accordance with the requirements of specification MIL-H-45444A (Ord) with Amendment 3 dated July 31, 1962.

These compositions were processed into essentially ¼ inch thick sheets by the process described in Example II. Acetone was used as the colloiding agent for nitrocellulose in Compositions 19 and 20 and ethyl acetate in Composition 21. Composition 19 was rolled at 165°F., Composition 20 at 158°F. and Composition 21 at 149°F. The sheet of Composition 19 appeared to be identical with that of Composition 2, Example I, with which it was identical compositionwise. Microscopic examination of thin slices of this sheet failed to reveal any indication of RDX particle size or shape alteration due to the use of acetone, an RDX and HMX solvent. Composition 20 was aged for about 40 hours with occasional stirring before it was rolled into a sheet. This composition gave a good, smooth, essentially ¼ inch thick sheet which was much more pliable than that of Composition 19 and in the surface of which could be seen many HMX particles. Microscopic examination of thin slices of this sheet and, for comparison, of thin slices of the sheet of Composition 21 revealed no indications of alteration of HMX particle size or shape due to use of acetone. The appearance of the ¼ inch thick sheet of Composition 21 was essentially identical with that of Composition 20 except for color. This sheet was also more pliable than that of Composition 19.

EXAMPLE VIII

| Composition No. | | 22 |
|---|---|---|
| HMX, Class B | 280g. | (56%) |
| Nitrocellulose | 20 | ( 4%) |
| DPA (added percent) | 1 | ( 0.2%) |
| TMETN | 200 | (40.0%) |

This mixture was processed as described in Example II using a rolling temperature of 165°F. A smooth flexible rubbery sheet was obtained. This material was partially characterized by the following test results.

| | |
|---|---|
| d 20/4[1] | 1.653g./cc. |
| Friction Pendulum Test (steel shoe)[2] | No crackles, flame, or explosion |
| P. A. Impact Sensitivity Test[3] | 10 inches |
| Vacuum Stability Test (5g./100°C./40 hrs.) | 0.95 ml. gas evolved |
| Cold Temperature Test[4] | +10°C. |

[1]The symbol d 20/4 indicates the ratio of the density of the explosive sheet at 20°C. to the density of water at 4°C.

[2]The Friction Pendulum Test (steel shoe) is described by J. H. McIvor in Picatinny Arsenal Testing Manual 7-1 dated May 8, 1950.

[3]The Picatinny Arsenal Impact Sensitivity Test is described in "Standard Laboratory Procedures for Sensitivity, Brisance, and Stability of Explosives", PATR No. 1401, March 18, 1944, Revised February 28, 1950, W. H. Rinkenbach and A. J. Clear.

[4]The Cold Temperature Test is described in paragraph 4.4.4.2 of specification MIL-E-46676 (MU) Amendment 1, 20 April 1963. In this Laboratory the test was run at various temperatures 10 centigrade degrees apart and the 1/4 inch diameter mandrel over which the samples were bent 90° in 5 seconds was at the same temperature as the samples tested. The test result is reported as that test temperature at which the 1/4 inch thick × 3/8 inch wide × 3 inch long sample neither breaks nor develops a crack deeper than 1/16 inch in the face away from the mandrel when bent as required.

EXAMPLE IX

| Composition No. | | 23 | |
|---|---|---|---|
| HMX, Class B (ethanol damp) | 6356.0g. | (dry basis) | (56.0%) |
| Nitrocellulose (ethanol damp) | 434.0 | (dry basis) | ( 4.0%) |
| DPA | 22.7 | | ( 0.2 added %) |
| TMETN | 4540.0 | | (40.0%) |

This 25-pound batch was prepared in a 5-gallon sigma blade mixer and formed into sheets on a large roll mill. The ethanol-moist HMX and nitrocellulose were blended and a solution of the DPA in 3000 milliliters of ethyl acetate mixed in portionwise over about 10 minutes. Finally the TMETN was added in about 500-gram increments over 15 minutes and the mixer temperature raised to 135–140°F., at which temperature mixing was carried out for 30 minutes with the mixer closed. At this point it became evident that colloiding was being hindered by the ethanol present and another 3000 milliliters of ethyl acetate was stirred in. After another 30-minute mixing at 135°F. with the mixer closed, the mix had attained the desired pasty consistency.

The mix was removed to a tightly covered container and aged overnight, after which it was rolled at 140°F. using a roll gap of 0.020 inch to remove all ethyl acetate and ethanol. Portions of this material were consolidated, using the roll mill, at 135°F., into 0.080-inch-and 0.160-inch-thick sheets for use in the Plate Damage Test described below. The remainder was rolled into essentially ¼ inch thick sheets, also at 135°F. All sheets were smooth, homogeneous, flexible, and rubbery. This material was partially characterized by the following test results:

| | |
|---|---|
| Rate of Detonation[1] | 7753 m./sec. |
| Cap Sensitivity Test[2] | No. 8 cap |
| Ballistic Pendulum Test (TNT = 1) | 1.332 |
| Color Test[3] | Passed |
| Hot Immersion Test[4] | Passed |
| Plate Damage Test[5] | Excellent cutting power |
| Bullet Impact Test[6] | No fire or explosions in 10 consecutive test firings. |

[1]Sample used: 1 inch × 1 inch × 15 inches long unconfined.

[2]A 1/4 inch wide × 3/4 inch deep slot is cut into one end of a 1/4-inch-thick × 1-inch-wide × 12-inch-long test specimen, a standard cap is inserted into the slot -continued and taped in place, and the cap fired. Test result is given as the smallest (lowest) number standard cap which will cause complete detonation of the test strip in five consecutive tests.

[3]The color test is described in paragraph 3.6.1.2 of specification MIL-E-46676 (MU) Amendment 1, 20 April 1963. Holding in 160°F. water 24 hours did not cause any essential color change in test samples.

[4]The Hot Immersion Test is described in paragraph 4.4.4.1 of specification MIL-E-46676 (MU) Amendment 1, 20 April 1963. After being held 24 hours in water at 160°F. samples could be bent 90° around a 1/4 inch diameter mandrel without cracking or breaking.

[5]The Plate Damage Test is carried out by centering a 3 inch × 10 inch sheet of explosive on a 4 inch × 12 inch × 1/4 inch thick mild steel plate set on a smooth damp sand surface. The sheet is fired with an M6 cap set into a 3/4 inch deep slot cut into the center of one end. In the case of 0.08 inch thick material, a small piece of the 0.08 inch thick material is laid across the top of the initiating cap so that both ends thereof are in contact with the sheet. This provides sufficient surface contact with the cap to insure initiation. In this test all sheets fired completely and examination of the steel plates showed this composition to be at least 50% more effective in cutting steel than a commercial flexible sheet explosive currently in military use or a non-proprietary replacement developed therefor, as described in U. S. 3,317,361 and 3,354,010. It was also noticeably more effective than the flexible sheet material of U. S. 3,400,025 and the British-made sheet explosive SX-2.

[6]The Bullet Impact Test is described in paragraph 4.2.2.7 of specification MIL-E-46676 (MU), Amendment 1, 20 April 1963. In this test a 30 calibre rifle bullet is fired into a test specimen 40 feet from the rifle muzzle. The test specimen is a 3 inch square of 1/4 inch thick explosive material sandwiched between a 1 inch thick steel backup plate and a 1/16 inch thick face plate.

EXAMPLE X

| Composition No. | 24 | 25 | 26 | 27 | 28 |
|---|---|---|---|---|---|
| HMX, Class B | 180.0g(60.0%) | 210.0g(70.0%) | 210.00g(70.0%) | 233.3g(70.0%) | 49.0g(14.70%) |
| HMX, Class C | — | — | — | — | 184.3g(55.30-%) |
| Nitrocellulose | 12.0g(4.0%) | 12.0g(4.0%) | 9.00g(3.00%) | 10.0g(3.0%) | 10.0g(3.00%) |
| DPA (added above 100%) | 0.6g(0.2%) | 0.6g(0.2%) | 0.45g(0.15%) | 0.5g(0.15%) | 0.5g(0.15%) |
| TMETN | 108.0g(36.0%) | 78.0g(26%) | 81.00g(27.00%) | 90.0g(27.0%) | 90.0g(27.00%) |

In all cases the nitrocellulose was added portionwise to about 100 times its weight of ethylacetate or butyl acetate under vigorous agitation at ambient temperature in a Cowles Dissolver after which the DPA and TMETN were added and agitation continued until an homogeneous lacquer was obtained. The lacquer was then added in a fine stream to a vigorously stirred suspension of the HMX in about 25 times its weight of distilled water held at about 60°C. After all lacquer had been added (including ethyl acetate rinsings of the lacquer preparation and adding equipment) the temperature of the mixture was raised to at least 75°C. to drive off all solvent and then dropped to 35°C. and the liquid phase removed by vacuum filtration. When dry, the product in each case consisted of discrete granules of about 1/16–⅛ inch in maximum dimension.

Composition 24 was rolled at 149°F. and a gap setting of 0.020 inch to consolidate the particles. The thin sheets thus formed were then consolidated into an essentially ¼-inch-thick sheet on the roll mill using a roll gap of 0.240 inch. A smooth flexible rubbery sheet was obtained which appeared, as expected, to be a little stiffer than the sheets obtained from Compositions 22 and 23 but otherwise physically identical therewith.

Compositions 25, 26, and 27 formed only flakes and chips when rolling was attempted, even at temperatures of 175°–180°F. No attempt was made to roll composition 28 to form a sheet.

Pellets ¾ inch in diameter and weighing about 20 grams were pressed from the granules of Compositions 25 and 26 and portions of Compositions 27 and 28 were pressed into 1½ inch-diameter × 50-gram pellets. In all cases the granules were placed in the mold, vacuum applied to lower the pressure in the mold to about 5mm. of Hg over a 5-minute dwell period, and the material then pressed using a 5-minute dwell period. The theoretical maximum density (TMD) of Composition 25 is 1.7338 and that of Compositions 26, 27, and 28 is 1.7525g./cc. Air temperature in the mold was 122°F. just before pressing Compositions 25 and 26, and 142°–144°F. just before pressing Compositions 27 and 28.

Density of Pressed Composition 25, 26, 27, and 28 Pellets

| Composition No. | Pressing Temp. (°F.) | Pressure (psi.) | Pellet d 20/4(g./cc.) | % TMD | Pellet (diam./in.) |
|---|---|---|---|---|---|
| 25 | 122° | 5,000 | 1.6540 | 95.40 | 0.75 |
| | 122° | 10,000 | 1.6734 | 96.52 | 0.75 |
| 26 | 122° | 5,000 | 1.7252 | 98.44 | 0.75 |
| | 122° | 10,000 | 1.7316 | 98.81 | 0.75 |
| 27 | 142° | 10,000 | 1.7118 | 97.68 | 1.50 |
| 28 | 144° | 10,000 | 1.5983 | 91.27 | 1.50 |

The difference in density of pellets pressed from Compositions 25 and 26 is an example of the disadvantage of a low TMETN/NC ratio: in Composition 25 the ratio is only 6.5/1 while in Composition 26 it is 9/1, which provides a softer, less flow-resistant binder system. The pellet obtained from Composition 27, even though pressed at a higher mold temperature, possessed a lower density than that obtained from Composition 26. The reason appears to be the larger mold and ram size which does not allow for as rapid heat absorption in the short total well time of 10 minutes. Desirability of preheating the material to be press-loaded is thus graphically illustrated. The low density of the Composition 28 pellet indicates that the use of coarse particulate high explosive (the Class C HMX in this case) is inadvisable in compositions of the type described in this invention which are to be press-loaded unless relatively low densities may be desired for specific effects. This composition (No. 28) produced a pellet which was slightly flexible when hot but, like the pellets pressed from Compositions 25, 26, and 27, was almost, but not completely rigid when cool.

EXAMPLE XI

| Composition No. | 29 |
|---|---|
| HMX (Class B) | 198.0g. (66.0%) |
| Nitrocellulose | 12.0g. ( 4.0%) |
| DPA (added above 100%) | 0.6g. ( 0.2%) |
| TMETN | 90.0g. (30.0%) |
| Theoretical Maximum Density (TMD) | 1.7358g./cc. |

This composition was prepared by the precipitation method described in Example X. Four batches were prepared and blended. The blended material was pressed at 8,000 psi, to form pellets about 2.5 inches in diameter using 2 increments of approximately the same weight in each case. Pressing details are:

| Pellet No. | 1. | 2. |
|---|---|---|
| Pressing Temperature (°F.) | 160° | 155° |
| Pellet Weight (g.) | 275.2 | 259.7 |
| Pellet Density (g./cc.) | 1.7320 | 1.7299 |
| Pellet Density as % of TMD | 99.78% | 99.66% |

While the present invention has been described in detail, it will be apparent to those skilled in the art that there are many variations possible without departing from the scope of this invention, which is limited only by the appended claims.

What is claimed is:

1. A self-supporting, high powered, brisant, explosive composition composed essentially entirely of explosive ingredients and consisting essentially of:

a. 46 to 87% by weight of a finely divided explosive selected from the group consisting of cyclotrimethylenetrinitramine, cyclotetramethylenetetranitramine, and pentaerythritol tetranitrate, and mixtures thereof having an average particle size not greater than about 25 microns;

b. 1 to 4% by weight of explosive, high-viscosity, nitrocellulose binder; and c. 12 to 49% by weight of the liquid explosive plasticizer trimethylolethane trinitrate, the ratio of said plasticizer to said nitrocellulose being in the range of 6.5/1 to 15/1.

2. A self-supporting, high powered, brisant, flexible, explosive composition composed essentially entirely of explosively active ingredients and consisting essentially of:

a. 46 to 70% by weight of a finely divided explosive selected from the group consisting of cyclotrimethylenetrinitramine, cyclotetramethylenetetranitramine and pentaerythritol tetranitrate, and mixtures thereof having an average particle size not greater than about 25 microns;

b. 3 to 4% by weight of explosive, high-viscosity, nitrocellulose binder; and c. 33 to 49% by weight of the liquid explosive plasticizer trimethylolethane trinitrate, the ratio of said plasticizer to said nitrocellulose being in the range of 9/1 to 15/1.

3. The composition of claim 2, wherein the finely divided explosive is cyclotrimethylenetrinitramine.

4. The composition of claim 2, wherein the finely divided explosive is cyclotetramethylenetetranitramine.

5. The composition of claim 2, wherein the finely divided explosive is pentaerythritol tetranitrate.

* * * * *